US007607907B2

(12) United States Patent
Shorten et al.

(10) Patent No.: US 7,607,907 B2
(45) Date of Patent: Oct. 27, 2009

(54) ROLLER VANE PUMP

(75) Inventors: Adrian Comillus Shorten, Groombridge (GB); Christopher J. McCrindle, West Malling (GB); Brian Eric Knell, Sheerness (GB); Stephen Gates, Chatham (GB)

(73) Assignee: WOP Industrias E Comercio De Bombas Ltda., Sao Paulo (BR)

( * ) Notice: Subject to any disclaimer, the term of this patent is extended or adjusted under 35 U.S.C. 154(b) by 346 days.

(21) Appl. No.: 10/940,546

(22) Filed: Sep. 14, 2004

(65) Prior Publication Data

US 2005/0118039 A1 Jun. 2, 2005

(30) Foreign Application Priority Data

Sep. 22, 2003 (GB) ..... 0322122.3

(51) Int. Cl.
*F04C 2/344* (2006.01)

(52) U.S. Cl. ..... 418/225; 417/410.3; 417/273; 418/227; 418/264; 418/268; 418/156

(58) Field of Classification Search ..... 417/218, 417/221, 274, 410.3, 410.4, 273; 418/225, 418/226, 227, 240, 250
See application file for complete search history.

(56) References Cited

U.S. PATENT DOCUMENTS 1,466,904 A * 9/1923 Jackson ..... 418/146
3,447,476 A * 6/1969 Farris ..... 418/225
3,886,764 A * 6/1975 Edwards ..... 62/402
4,274,392 A 6/1981 Myers
4,284,392 A 8/1981 Pareja
4,673,341 A * 6/1987 Bristow ..... 418/26

(Continued)

FOREIGN PATENT DOCUMENTS

DE 19837275 A1 3/2000

(Continued)

OTHER PUBLICATIONS

Materials Engineering Laboratory Data Report Plenco 060401, Plastics Engineering Company: http://www.plenco.com/data/06401i.pdf.*

(Continued)

*Primary Examiner*—Devon C Kramer
*Assistant Examiner*—Leonard J Weinstein
(74) *Attorney, Agent, or Firm*—Young, Basile, Hanlon & MacFarlane, P.C.

(57) ABSTRACT

A roller vane pump for fluid includes a carrier which is rotatable in a housing about an axis of rotation, the carrier carrying a plurality of roller vanes which are each received in a respective slot which extends inwardly of a periphery of the carrier and permits the roller to move inwardly and outwardly in use, the housing surrounding the carrier, pumping chambers being formed between the rollers, the carrier and the housing, the rollers engaging with the housing and moving inwardly and outwardly of their respective slots as the carrier rotates, in response to the configuration of the housing so that the pumping chambers change in volume as the carrier rotates, to effect pumping of the fluid, from an inlet to an outlet of the pump, and wherein in each of the slots in which the rollers are received, there is provided a restrictor element which restricts movement of the roller inwardly of its respective slot.

19 Claims, 3 Drawing Sheets

U.S. PATENT DOCUMENTS

| | | | | |
|---|---|---|---|---|
| 4,738,596 | A * | 4/1988 | Abinett et al. | 417/252 |
| 4,828,468 | A * | 5/1989 | Sipe et al. | 418/225 |
| 5,378,111 | A * | 1/1995 | Christopher | 417/203 |
| RE34,956 | E * | 5/1995 | Djordjevic | 417/462 |
| 5,630,399 | A | 5/1997 | Nomura et al. | |
| 5,733,113 | A * | 3/1998 | Grupping | 418/188 |
| 5,895,209 | A | 4/1999 | Miyazara | |
| 6,200,114 | B1 * | 3/2001 | Brighton et al. | 418/31 |
| 6,250,279 | B1 * | 6/2001 | Zack | 123/241 |
| 6,398,528 | B1 | 6/2002 | Hansen et al. | |
| 2001/0036411 | A1 | 11/2001 | Walker | |
| 2004/0219036 | A1 * | 11/2004 | Lang | 417/410.3 |

FOREIGN PATENT DOCUMENTS

| | | | |
|---|---|---|---|
| DE | 1013386 | | 10/2002 |
| EP | 0095194 | | 11/1983 |
| WO | WO 94/01679 | | 1/1994 |
| WO | WO 01/92731 | A1 | 12/2001 |
| WO | WO 02/063170 | A1 | 8/2002 |

OTHER PUBLICATIONS

Young's modulus, http://en.wikipedia.org/w/index.php?title=Young%27s_modulus&oldid=258959909, (last visited Dec. 20, 2008).*
English Language Abstract for SU 1359484 A.
English Language Abstract of DE 1013386.
English Language Abstract of DE 19837275.
Search Report issued by United Kingdom patent office in priority application GB 0322122.3 (Feb. 17, 2004).
English Language Abstract for JP 56-115889 A.

* cited by examiner

ROLLER VANE PUMP

This application claims priority to United Kingdom Patent Application No. 0322122.3 filed Sep. 22, 2003, the entire disclosure of which is incorporated herein by reference.

BACKGROUND TO THE INVENTION

This invention relates to a roller vane pump and, more particularly, but not exclusively, to a roller vane pump suitable for use in a pumping system for pumping fuel from a reservoir to a fuel injection apparatus for an engine to raise the fuel pressure prior to its further pressurization in the fuel injection apparatus.

A pump for a pumping system for initially pressurizing fuel is desired reliably to increase the fuel pressure by say, 5 bar, compared to pressures attained in the fuel injection apparatus, which could be as great as 2000 bar, necessary for injecting the fuel into the combustion chamber or chambers of the engine.

DESCRIPTION OF THE PRIOR ART

Various proposals have been put forward for suitable pump designs. Examples are exemplified in, for example, U.S. Pat. Nos. 5,630,399 (Nomura), 4,738,596 (Lucas), and 5,895,209 (Jidosha), and in European patent application EP0095194 (Nissan).

SUMMARY OF THE INVENTION

According to a first aspect of the present invention, we provide a pump for fluid, the pump including a carrier which is rotatable in a housing about an axis of rotation, the carrier carrying a plurality of roller vanes which are each received in a respective slot which extends inwardly of a periphery of the carrier and permits the roller to move inwardly and outwardly in use, the housing surrounding the carrier, pumping chambers being formed between the rollers, the carrier and the housing, the rollers engaging with the housing and moving inwardly and outwardly of their respective slots as the carrier rotates in response to the configuration of the housing so that the pumping chambers change in volume as the carrier rotates to effect pumping of the fluid from an inlet to an outlet of the pump, and wherein in each of the slots in which the rollers are received, there is provided a restrictor element which restricts movement of the roller inwardly of its respective slot.

Particularly by using such a vane pump in a pumping system for lifting fuel, a low cost yet reliable solution is provided for raising the fuel pressure prior to pressurization in the fuel injection apparatus.

Desirably, each restrictor element prevents its respective roller moving inwardly of its slot to a position at which the roller would otherwise be capable of disengaging the housing as the carrier rotates.

The restrictor elements may be provided integrally with the remainder of the carrier and thus preferably the carrier is made from a material which exhibits some resilience, such as a suitable resilient plastic, each restrictor element biasing its respective vane into engagement with the housing during carrier rotation, at least when the roller has been moved inwardly of its respective slot into co-operation with the restrictor element.

The slots of the carrier may each extend inwardly of the carrier from the periphery thereof to a bottom, and each restrictor element may occupy part only of an axial depth of the carrier, so that a space is always preserved between bottom of the slot and its respective roller.

Each slot may include a wider region in which the roller is moveable inwardly and outwardly of the carrier, and a narrowed region towards the bottom of the slot, and the respective restrictor element may be provided at or adjacent a position where the wider and narrower regions meet.

The pump may be a variable displacement pump in which case the housing of the pump may include a moveable cam with which the rollers engage as the carrier rotates, the cam being moveable relative to the carrier about a pivot axis which is generally parallel to the axis of rotation of the carrier to vary the displacement of the pump, there being a resilient biasing device to bias the cam in one direction about the pivot axis, and the housing including a passage which communicates with the outlet of the pump and communicates the outlet pressure of the pumped fuel from the outlet to act on the cam to oppose the biasing force of the resilient biasing device so that the pump displacement varies depending upon the pump outlet pressure.

Although the pump may be driven by any desired means, preferably the pump is mechanically driven, the carrier in use, being mechanically connected to a drive shaft of a transmission.

Whereas the pump is particularly useful as a fuel lift pump, the pump may be used for other purposes, for example as a pump for pumping lubricating oil.

According to a second aspect of the invention, we provide a pumping system for pumping fuel from a reservoir to a fuel injection apparatus for an engine to raise the fuel pressure prior to its further pressurization in the fuel injection apparatus, the system including a pump in a line between the reservoir and the fuel injection system, and wherein the pump is a roller vane pump including a carrier which is rotatable in a housing about an axis of rotation, the carrier carrying a plurality of roller vanes which are each received in a respective slot which extends inwardly of a periphery of the carrier and permits the roller to move inwardly and outwardly in use, the housing surrounding the carrier, pumping chambers being formed between the rollers, the carrier and the housing, the rollers engaging with the housing and moving inwardly and outwardly of their respective slots as the carrier rotates in response to the configuration of the housing so that the pumping chambers change in volume as the carrier rotates to effect pumping of the fluid from an inlet to an outlet of the pump, and wherein in each of the slots in which the rollers are received, there is provided a restrictor element which restricts movement of the roller inwardly of its respective slot.

Thus, in the system, the pump may pump fuel to one of a high pressure pump and an injector pump of the fuel injection apparatus by means of which the fuel is further pressurized to a pressure at which the fuel is to be injected into the engine.

In the fuel line between the pump and the fuel injection apparatus, there may be provided a regulator valve to limit the pressurization of the fuel by the pump so that the regulator valve vents excess fuel to the inlet side of the line from the reservoir or back to the reservoir.

BRIEF DESCRIPTION OF THE DRAWINGS

Embodiments of the invention will now be described with reference to the accompanying drawings in which.

DESCRIPTION OF THE PREFERRED EMBODIMENTS

Figure 1:
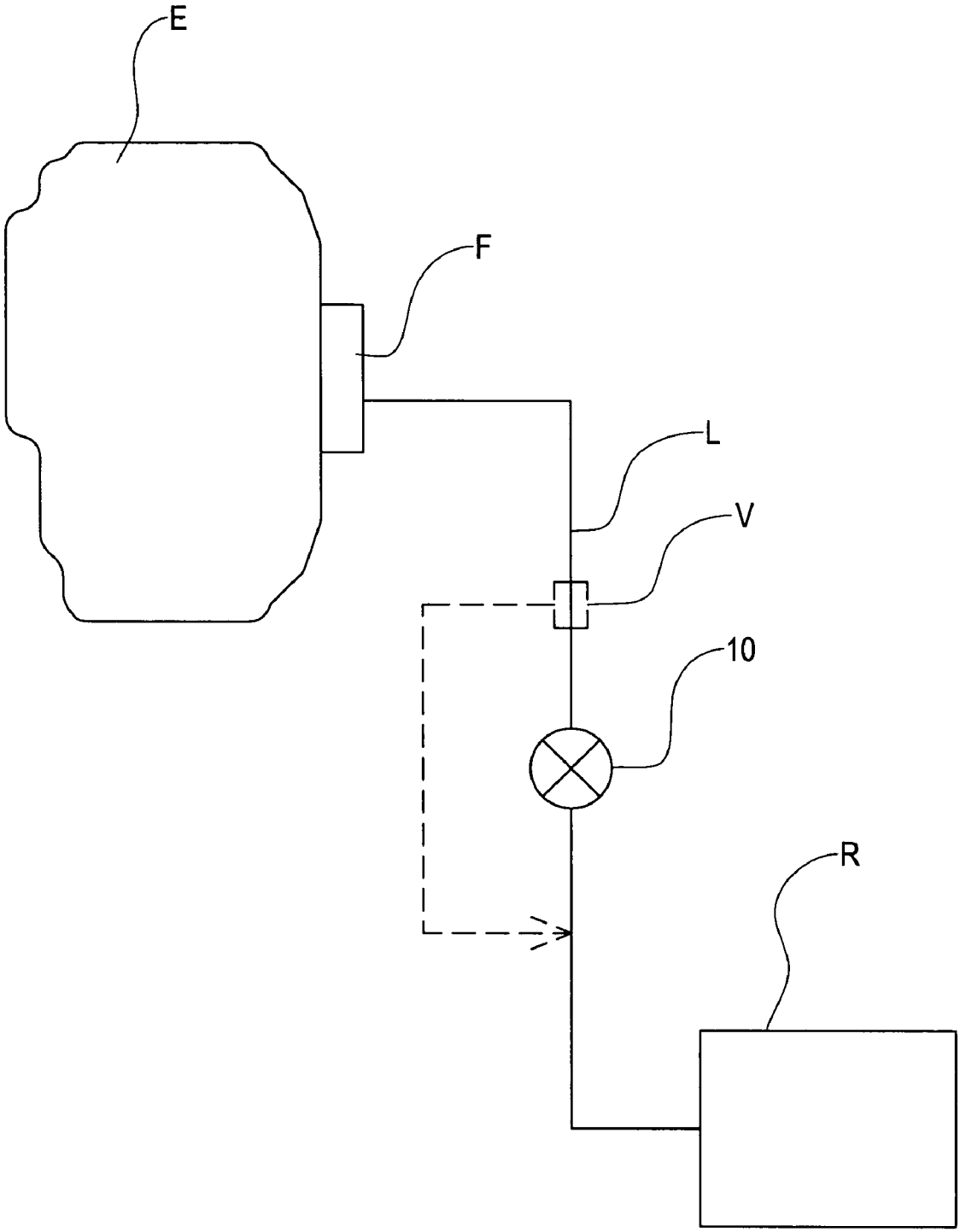
FIG. 1 is a diagrammatic illustration of a pumping system including a pump in accordance with the invention.

FIG. 1 shows a pumping system for pumping fuel from a reservoir R to a fuel injection apparatus F of an engine E in this example of an automobile. The pumping system includes a line L which extends from the reservoir R to the fuel injection apparatus F and a pump 10 in the line L. For example, the fuel injection apparatus F may include a high pressure pump which may feed a common rail, or an injector pump, by means of which fuel is very highly compressed, and injected into a respective combustion chamber of the engine E.

The pump 10 is, in accordance with the first aspect of the invention, a roller vane pump which may be a variable displacement roller vane pump 10 as will be described with reference to the remaining figures, or a fixed displacement roller vane pump. Particularly but not exclusively in the latter case, preferably there is provided a regulator valve as shown in dotted lines at V, in the line L between the pump 10 and the fuel injection apparatus F. The regulator valve V relieves excess pressure developed in the line L, by directing some of the pumped fluid back to an inlet of the pump 10. This is required because in the case of a roller vane pump 10 which is mechanically driven from the engine E, the pump 10 output will depend upon the engine speed and at high engine speeds, the pump 10 may increase the pressure of the fuel beyond that which is required.

It will be appreciated that the role of the roller vane pump 10 is to increase the pressure of the fuel as the fuel flows along the line L, although the fuel is more highly pressurized in the fuel injection apparatus F, by a pump of the fuel injection apparatus, to a pressure at which the fuel may be injected into the one or more combustion chambers of the engine E, when air in the combustion chamber is already highly compressed.

Figure 2:
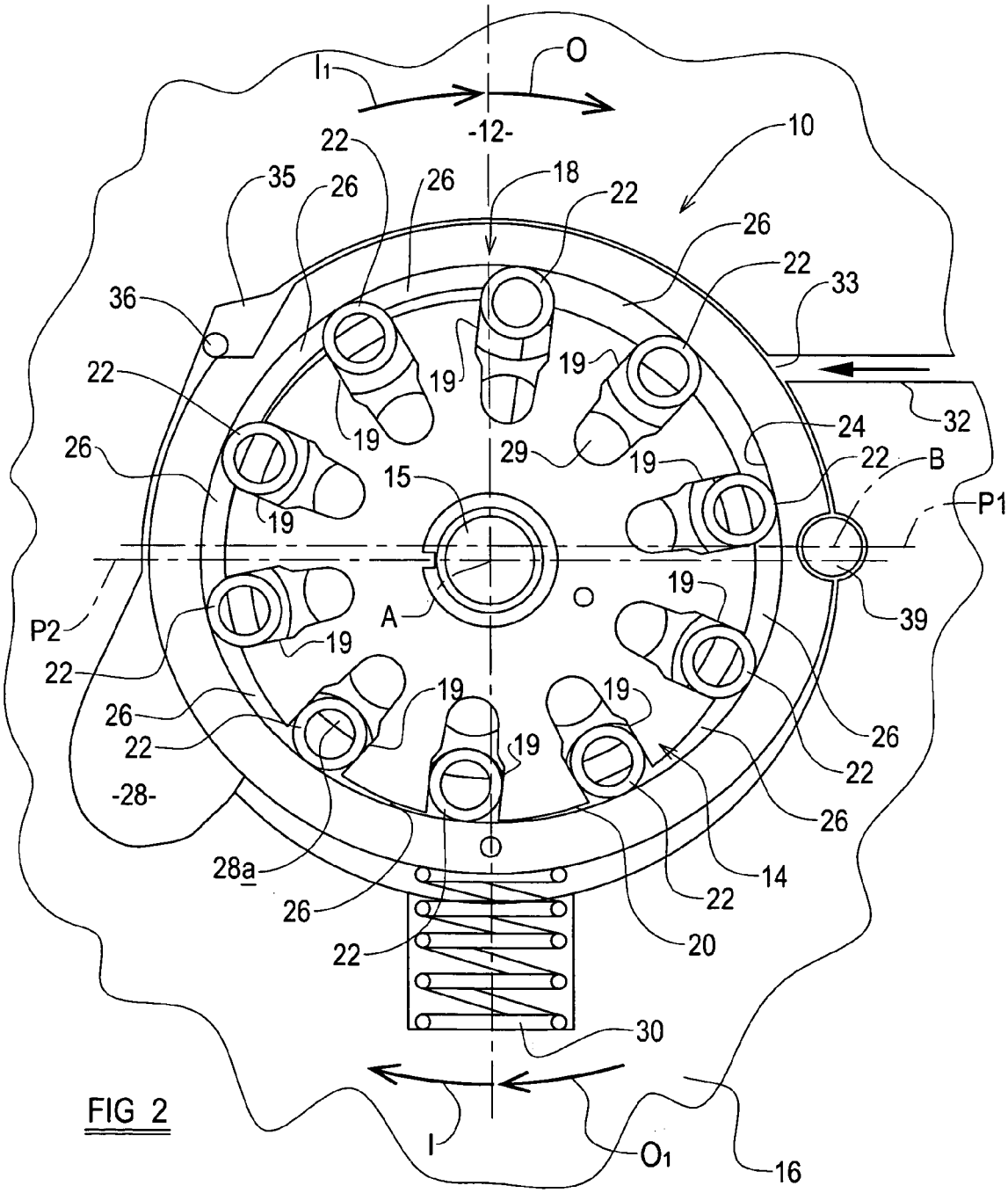
FIG. 2 is a diagrammatic illustration of the pump of the pumping system of FIG. 1.

Referring to FIG. 2, a construction of a variable displacement roller vane pump is shown, which may be used as an alternative to the fixed displacement pump and regulator valve V combination shown in FIG. 1. The displacement of the pump 10 of FIG. 2 is variable as the pressure developed by the pump 10 increases, so that no excess of pressurization occurs in normal use which would require relieving from the line L from between the pump 10 and the fuel injection apparatus F.

The roller vane pump 10 includes a housing 12 in which a carrier 14 is rotatable about an axis of rotation A. In this example the carrier 14 is connected, e.g. by a splined connection, to a prime mover 15 which is a driven shaft of the internal combustion engine E. The housing 12 includes an outer housing part 16, and a cam 18, the cam 18 being movable relative to both the outer housing part 16 and the carrier 14 about a pivot axis B, as explained below, to achieve variance in the displacement of the pump 10.

The carrier 14 includes a plurality of slots 19 which extend inwardly of the carrier 14 from an outer periphery 20 of the carrier 14, each slot 19 accommodating a cylindrical roller 22 each of which may rotate and may move in its respective slot 19, inwardly and outwardly of the carrier 14, so that as the carrier 14 rotates, the rollers 22 are maintained in contact with an inner cam surface 24 of the cam 18, in response to forces experienced as the carrier 14 rotates. The rollers 22 rotate about their respective cylindrical axes, so that in such a pump 10, there is minimal wear due to the contact between the rollers 22 and the cam 18.

A centre of the cam 18 is offset with respect to the axis of rotation A of the carrier 14, and so as the carrier 14 rotates, pumping chambers 26 are formed between an adjacent pair of rollers 22, the inner cam surface 24 and the carrier 14, the pumping chambers 26 changing in volume as the carrier 14 rotates. The pumping chamber 26 volume is at a minimum immediately prior to an fuel inlet 28, increasing to a maximum at an opposite position. Thus low pressure fuel is drawn from the inlet 28 into the pumping chambers 26 as the pumping chamber volumes increase, and higher pressure fuel is discharged from the pumping chambers 26 as their volumes decrease, into an outlet.

In the example shown in the drawings, an inlet port is provided at an axial end of the pump 10, below the carrier 14 as drawn, a portion of the inlet port being visible at **28*a*. The port 28*a* may extend arcuately so that fuel may be drawn simultaneously into several of the pumping chambers 26** as their volumes increase.

The outlet from the pump 10 also includes a port, at an axial end of the pump 10, part of which can be seen at 29, and which outlet port 29 may extend arcuately so that fuel may be discharged simultaneously from several of the pumping chambers 26, and slots 19, as their volumes decrease.

As seen in the drawing, generally through half of the carrier 14 revolution, indicated between the arrows I and $I_1$, fuel will be drawn into the pump 10, whereas through the other half of the carrier revolution indicated between the arrows O and $O_1$, fuel will be discharged.

The maximum pumping chamber 26 volume is governed by the position of the cam 18 about the cam pivot axis B, and it will be appreciated that by moving the cam 18 about the cam pivot axis B, the displacement of the pump 10, and hence the fuel pressure developed, may be varied.

In use, as engine speed increases, more fuel will be pumped by the pump 10 as the rotational speed of the carrier 14 will increase. To prevent the pressure developed exceeding a threshold pressure beyond which it is desirable not to increase the fuel pressure, it is desirable to reduce the pump 10 output by adjusting the position of the cam 18 in the outer housing part 16.

To achieve this, a resilient biasing device 30, namely a coil spring, acts between the cam 18 and the outer housing part 16, so as to move the cam 18 about the pivot axis B so as urge the cam 18 such as to maximize the volumes of the pumping chamber 26 as fluid is drawn into the pump 10, so as to maximize the displacement of the pump 10. However, to counter the biasing force of the spring 30, the pressure of pumped fluid from the outlet is communicated via a passage 32 to act on an external surface 33 of the cam 18, in a pressure chamber formed between the outer housing part 16 and the external surface 33 of the cam 18.

The pressure chamber extends from adjacent the pivot axis through about 120°, but preferably at least through 90°, to a seal chamber 35 where a seal 36 is provided, to prevent the higher pressure fuel escaping to the low pressure inlet 28.

Thus as the pressure of the discharged fuel at the outlet 29 increases, the cam 18 will be urged against the force of the spring 30 so as to reduce the displacement of the pump 10 and thus restrict the pressure of the fuel in the lubrication system to below that at which the pressure could damage the oil filter.

Figure 3:
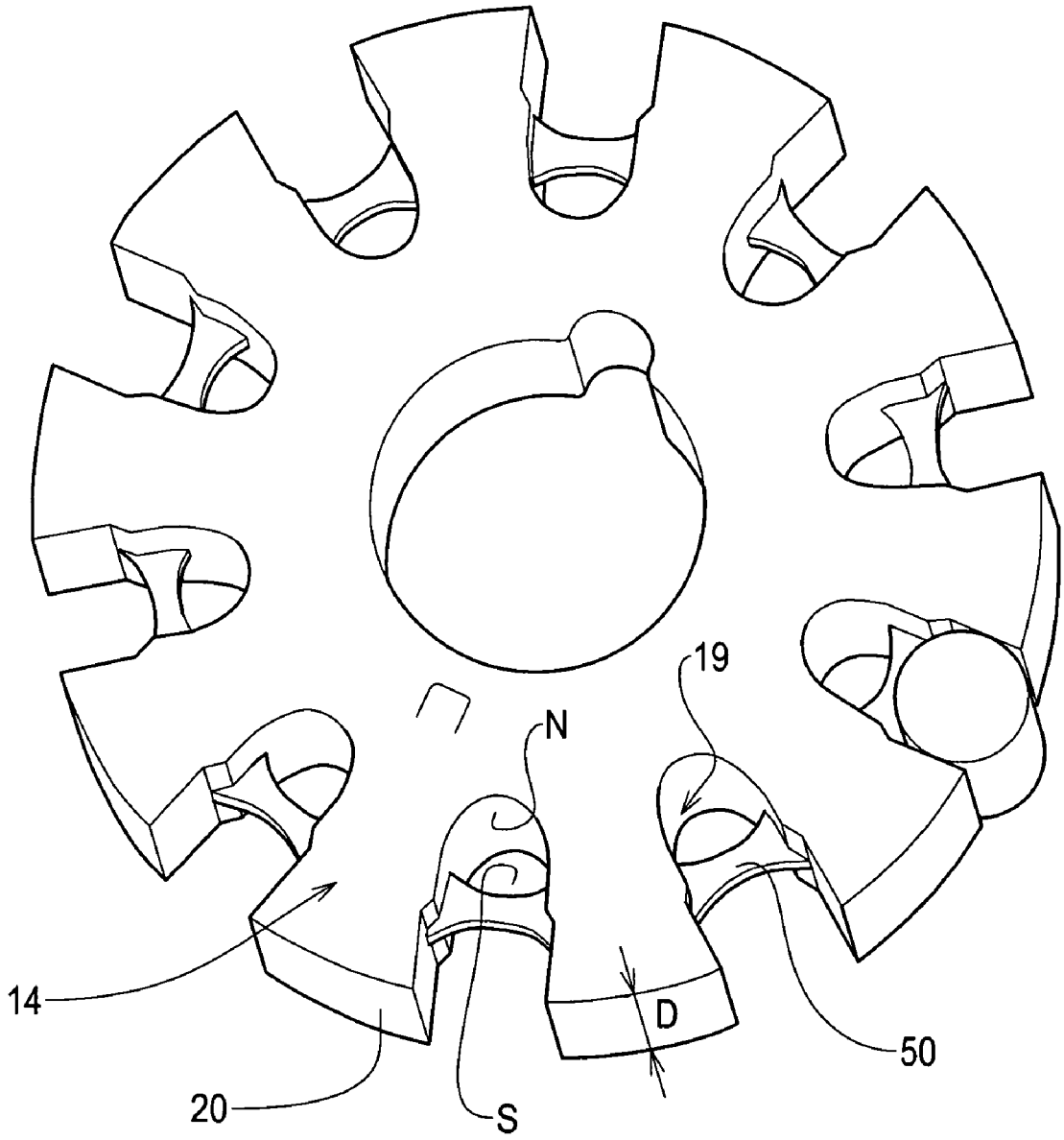
FIG. 3 is a perspective view of part of the pump of FIG. 2, removed from the pump, for clarity.

Referring now also to FIG. 3, the carrier 14 is shown in more detail.

The carrier 14 is made from a suitable plastic material which exhibits some resilience. It can be seen that within each of the slots in which the rollers 22 are received, there is provided a restrictor element 50 which restricts the roller 22 from moving inwardly of its respective slot 19 as the carrier 14 rotates, at certain rotational positions.

Each restrictor element 50 is preferably provided integrally with the remainder of the carrier 17 but in another example, similar restrictor elements 50 may be provided by separate component assemblies into the slots 19.

When a roller 22 is moved inwardly of its respective slot 19 by the configuration/position of the cam 18, around at least some of the carrier 14 rotation, the roller 22 will be urged into engagement with its respective restrictor element 50 which, due to the flexibility/resilience of the carrier 14 or at least of the restrictor element 50, will bias the roller 22 outwardly of its respective slot 19 into engagement with the cam 18 to maintain sealing between the roller 22 and the cam 18. In any event, the restrictor elements 50 will act to prevent their respective rollers 22 from moving inwardly of the slot 19 to a position at which the roller 22 would otherwise be capable of disengaging the cam 18 of the housing 12 as the carrier 17 rotates.

In practice, the pump 10 shown in FIG. 2 will be orientated "upside down" compared to the orientation shown, so that the rollers 22 will be minimally outwardly displaced of their respective slots 19, when the slots 19 are generally vertically upwards. This position is generally between the inlet port 28 and the outlet port 29.

In this position in the absence of the restrictor elements 50, the rollers 22 could fall under gravity, particularly at low pump rotational speeds, into their slots 19, and out of engagement with the cam 18, thereby permitting the high pressure fuel at the outlet port 29 to pass the roller 22 and escape to the lower pressure inlet port 28.

The slots 19 each extend from the periphery of the carrier where there is a wider region in which the roller 22 may move inwardly and outwardly of the carrier, to a slot bottom, and the slots 19 are further shaped so that there is a narrow region N furthermost inwardly of the periphery 20 of the carrier 14. The restrictor elements 50 are only thin and occupy part only of the axial depth D of the carrier 14, so that a space S is always preserved between the bottoms of the slots 19 and the rollers 22, so that there is no closed chamber which could trap fuel and resist inward roller 22 movement. The restrictor elements 50 are each provided at or near the position where the wider and narrower slot regions meet.

Desirably, as the slots 19 approach the pump outlet 29, fuel discharged axially from the slots 19 as the rollers 22 move inwardly of the carrier 14, may be communicated to the outlet 29 at one or both of the axial ends of the pump 10.

It will be appreciated that the geometry of each restrictor element 50 shown in the drawing is only exemplary, and that other configurations may be used. The number of slots 19 and rollers 22 shown in the drawings is only exemplary too, and in another construction, the carrier 14 may have an alternative number of slots 19 for the rollers 22.

As the rollers 22 only move outwardly into sealing engagement with the internal surface 24 of the cam 18 in response to the forces experienced as the carrier 14 rotates, at slow rotational speeds, there is some tendency for a reliable seal not to be maintained, at least where the restrictor elements 50 are ineffectual, i.e. where there is a large distance between the periphery 20 of the carrier 14 and the cam 18. Thus to assist in maintaining sealing, the slots 19 in which the rollers 22 are received, do not extend inwardly of the carrier 14 exactly radially, but the slots 19 are inclined to the radial, so that the rollers 22 more easily are moved outwardly by even weak rotational forces into sealing engagement with the inside surface 24 of the cam 18.

The seal 36 which is provided to prevent the escape of fuel from the pressure chamber to which the outlet pressure is communicated via the passage 32, is in this example cylindrical and may be made from metal, or a suitable synthetic material. The cylindrical axis of the seal 36 is generally parallel to the axis of rotation A of the carrier 14. The outer housing part 16 and external surface 20 of the cam 18 provide between them the seal chamber 35 which decreases in cross section towards the pump inlet 28. The seal 36 in use is radially urged by the higher pressure pumped fluid in the pressure chamber, along the decreasing cross section to provide sealing which becomes increasingly efficient as the differential between the outlet and inlet pressures increases.

In the example of FIG. 2, the cam 18 is pivoted about axis B on a pivot pin 39 although other pivot arrangements may be employed.

Although in the example of FIG. 2, the resilient biasing device 30 is a coil spring, any other preferably simple mechanical, resilient biasing device 30 may be provided as appropriate.

In the example shown in FIG. 2 of the drawings, the cam pivot axis B lies in a plane P1 which defines the extent of the pump inlet 28, which inlet 28 otherwise lies at a side of the plane P1 common to the resilient biasing device 30, and the axis of rotation A of the carrier 14 lies to the one side of the plane P1 too, e.g. in another plane P2. Other geometries are possible. Desirably, resilient biasing device 30 acts in a direction generally perpendicular to the plane P1.

It will be appreciated that a carrier 14 construction, such as shown in the pump of FIG. 2 but in more detail in FIG. 3 may be applied generally to any roller vane type pumps in which the vanes are rollers 22 as described and are received in and which may move at least outwardly and inwardly of slots 19 of the carrier 14.

Such a pump may be a fixed displacement vane pump in which case a cam 18 may not be provided, but the rollers 22 otherwise engage with the housing as the carrier 14 rotates to provide the pumping chambers 26.

A pump which may be used to pump an alternative fluid to fuel may utilize the carrier 14 construction described above, and the other particular features of the pump 10 described with reference to the drawings, for example, pump for pumping lubrication oil in an engine.

We claim:

1. A roller vane pump for fluid, the pump including a carrier which is rotatable in a housing about an axis of rotation, the carrier carrying a plurality of roller vanes which are each received in a respective slot which extends inwardly of a periphery of the carrier and permits the roller vane to move inwardly and outwardly in use, the housing surrounding the carrier, pumping chambers being formed between the roller vanes, the carrier and the housing, the roller vanes engaging with the housing and moving inwardly and outwardly of their respective slots as the carrier rotates, in response to the configuration of the housing so that the pumping chambers change in volume as the carrier rotates, to effect pumping of the fluid, from an inlet to the outlet of the pump, and wherein in each of the slots in which the roller vanes are received, there is provided a restrictor element which restricts movement of the roller inwardly of its respective slot, each restrictor element occupying part only of an axial depth of its respective slot such that each restrictor element has a width substantially equal to the diameter of its respective roller vane and extending across the entire span of its respective slot, so that a space is always preserved between the bottom of the slot and its respective roller vane.

2. A pump according to claim 1 wherein each restrictor element prevents its respective roller vane moving inwardly of its slot to a position at which the roller vane would otherwise be capable of disengaging the housing as the carrier rotates.

3. A pump according to claim 1 wherein each slot includes a wider region in which the roller vane is moveable inwardly and outwardly of the carrier, and a narrowed region towards the bottom of the slot, and the respective restrictor element is provided at or adjacent a position where the wider and narrower regions meet.

4. A pump according to claim 1 wherein the roller vane pump is a variable displacement pump.

5. A pump according to claim 4 wherein the housing of the pump includes a moveable cam with which the roller vanes engage as the carrier rotates, the cam being moveable relative to the carrier about a pivot axis which is generally parallel to the axis of rotation of the carrier to vary the displacement of the pump, there being a resilient biasing device to bias the cam in one direction about the pivot axis, and the housing including a passage which communicates with the outlet of the pump and communicates the outlet pressure of the pumped fuel from the outlet to act on the cam to oppose the biasing force of the resilient biasing device so that the pump displacement varies depending upon the pump outlet pressure.

6. A pump according to claim 1 wherein the pump is mechanically driven, the carrier in use, being mechanically connected to a drive shaft of a transmission.

7. A pump according to claim 1 which is for pumping lubricating oil.

8. A pumping system for pumping fuel from a reservoir to a fuel injection apparatus for an engine to raise the fuel pressure prior to its further pressurization in the fuel injection apparatus, the system including a pump in a line between the reservoir and the fuel injection system, and wherein the pump is a roller vane pump including a carrier which is rotatable in a housing about an axis of rotation, the carrier carrying a plurality of roller vanes which are each received in a respective slot which extends inwardly of a periphery of the carrier and permits the roller vane to move inwardly and outwardly in use, the housing surrounding the carrier, pumping chambers being formed between the roller vanes, the carrier and the housing, the roller vanes engaging with the housing and moving inwardly and outwardly of their respective slots as the carrier rotates, in response to the configuration of the housing so that the pumping chambers change in volume as the carrier rotates, to effect pumping of the fluid, from an inlet to an outlet of the pump, and wherein in each of the slots in which the roller vanes are received, there is provided a restrictor element which restricts movement of the roller vane inwardly of its respective slot, the restrictor elements each being provided integrally with the remainder of the carrier, and the carrier and the integral restrictor elements being made from a material which exhibits some resilience, each restrictor element biasing its respective roller vane into engagement with the housing during carrier rotation, at least when the roller vane has been moved inwardly of its respective slot into co-operation with the restrictor element, and each restrictor element occupying part only of an axial depth of its respective slot and extending across the entire span of its respective slot, so that a space is always preserved between the bottom of the slot and its respective roller vane.

9. A system according to claim 8 wherein the pumping system pumps fuel to one of a high pressure pump and an injector pump of the fuel injection apparatus by means of which the fuel is further pressurized to a pressure at which the fuel is to be injected into the engine.

10. A system according to claim 8 wherein in the fuel line between the pump and the fuel injection apparatus, there is provided a regulator valve to limit the pressurization of the fuel by the pump.

11. A system according to claim 10 wherein the regulator valve vents excess fuel to the inlet side of the line from the reservoir, or back to the reservoir.

12. A system according to claim 10 wherein the pump is a fixed displacement pump.

13. A roller vane pump for fluid, comprising:

a carrier having a plurality of slots that extend from a periphery of the carrier to a bottom of each slot;

a plurality of roller vanes disposed within respective slots of the plurality of slots;

a plurality of restrictor elements rigidly connected to the carrier, each restrictor element extending into a respective slot of the plurality of slots to an intermediate location between the periphery of the carrier and the bottom of each slot, wherein the restrictor elements are engageable with the roller vanes to space the roller vanes from the bottoms of the slots;

each slot defined by a pair of opposed walls that extend from the periphery of the carrier to the bottom of the slot; and each restrictor element rigidly connected to and extending completely between the opposed walls of its respective slot.

14. The roller vane pump of claim 13, further comprising:

each slot having a first axial depth; and the restrictor elements having a second axial depth, wherein the second axial depth is smaller than the first axial depth.

15. The roller vane pump of claim 14, wherein a top axial surface of each restrictor element is axially spaced from a top axial surface of the carrier and a bottom axial surface of each restrictor element is axially spaced from a bottom axial surface of the carrier.

16. The roller vane pump of claim 13, further comprising:

each restrictor element extending across the entire span of its respective slot.

17. The roller vane pump of claim 13, wherein the restrictor elements are fabricated from a resilient plastic material.

18. A roller vane pump for fluid comprising:

a carrier having a plurality of slots that extend from a periphery of the carrier to a bottom of each slot;

a plurality of roller vanes disposed within respective slots of the plurality of slots;

a plurality of restrictor elements rigidly connected to the carrier, each restrictor element extending into a respective slot of the plurality of slots to an intermediate location between the periphery of the carrier and the bottom of each slot, wherein the restrictor elements are engageable with the roller vanes to space the roller vanes from the bottoms of the slots;

each slot having a first axial depth;

the restrictor elements having a second axial depth, wherein the second axial depth is smaller than the first axial depth, wherein a top axial surface of each restrictor element is axially spaced from a top axial surface of the carrier and a bottom axial surface of each restrictor element is axially spaced from a bottom axial surface of the carrier; and each restrictor element having a leading edge that is spaced from the periphery of the carrier and a trailing edge that is spaced from the bottom of its respective slot.

19. A roller vane pump for comprising:

a carrier having a plurality of slots that extend from a periphery of the carrier to a bottom of each slot;

a plurality of roller vanes disposed within respective slots of the plurality of slots;

a plurality of restrictor elements rigidly connected to the carrier, each restrictor element extending into a respective slot of the plurality of slots to an intermediate location between the periphery of the carrier and the bottom of each slot, wherein the restrictor elements are engageable with the roller vanes to space the roller vanes from the bottoms of the slots;

each slot defined by a pair of opposed walls that extend from the periphery of the carrier to the bottom of the slot;

each restrictor element rigidly connected to and extending completely between the opposed walls of its respective slot; and each restrictor element having a substantially arcuate leading edge, such that the leading edge of each restrictor element is closer to the bottom of its respective slot at a center point along the restrictor element than adjacent at a point adjacent to the opposed walls of its respective slot.

* * * * *

UNITED STATES PATENT AND TRADEMARK OFFICE

CERTIFICATE OF CORRECTION

PATENT NO. : 7,607,907 B2
APPLICATION NO. : 10/940546
DATED : October 27, 2009
INVENTOR(S) : Shorten et al.

It is certified that error appears in the above-identified patent and that said Letters Patent is hereby corrected as shown below:

In Col. 2, lines 8-9, please delete "pump in which case the" and insert --pump, in which case, the--;

In Col. 4, line 57, please delete "Thus as" and insert --Thus, as--;

In Col. 5, line 2, please delete "rotates, as" and insert --rotates as--;

In Col. 5, line 4, please delete "17 but in" and insert --17, but, in--;

In Col. 5, line 45, please delete "19 as" and insert --19, as--;

In Col. 5, line 56, please delete "rotates, at" and insert --rotates at--;

In Col. 5, line 60, please delete "Thus to" and insert --Thus, to--;

In Col. 5, line 62, please delete "received, do" and insert --received do--;

In Col. 6, lines 3-4, please delete "32, is in this example cylindrical" and insert --32 is, in this example, cylindrical--;

In Col. 6, line 4, please delete "metal, or" and insert --metal or--;

In Col. 6, line 27, please delete "Desirably, resilient" and insert --Desirably, the resilient--; and In Col. 6, line 42, please delete "example, pump" and insert --example, a pump--.

Signed and Sealed this

Fifteenth Day of December, 2009

David J. Kappos

David J. Kappos
*Director of the United States Patent and Trademark Office*